United States Patent [19]

Harris

[11] 3,979,121

[45] Sept. 7, 1976

[54] EDUCATIONAL BOARD GAME

[76] Inventor: John Harris, 18717 Ramar St., Northridge, Calif. 91324

[22] Filed: Nov. 11, 1974

[21] Appl. No.: 522,337

[52] U.S. Cl. ..... 273/134 AD; 273/134 B; 273/134 C; 273/134 D; 273/134 AT

[51] Int. Cl.[2] ..... A63F 3/00

[58] Field of Search ..... 273/134

[56] References Cited

UNITED STATES PATENTS 3,858,885 1/1975 Adcock ..... 273/134 B

*Primary Examiner*—Delbert B. Lowe

*Attorney, Agent, or Firm*—John J. Posta, Jr.

[57] ABSTRACT

A novel educational board game includes a game board bearing a plurality of separate circuitous pathways, each pathway preferably commencing and ending at a central reward space common to the pathways. Each pathway bears a plurality of separate transfer stations interspersed with penalty stations and one or more reward stations. The transfer stations of a given pathway bear individual matching indicia of other pathways. Individual player markers are moved progressively from station to station along the pathways, the number of steps or stations moved corresponding to the number thrown by dice. Rewards are given at reward stations and individualized tokens issued to represent the rewards.

Tally figures, preferably three-dimensional animal figures, such as birds, receive the tokens, such as feathers, as they are earned in progressing toward a successful conclusion of the game. Markers are transferrable at discretion between matching transfer stations in separate pathways to avoid penalty stations and to aid in acquiring needed tokens. Accordingly, the game requires concentration, thought and skill. Preferably, the game rewards represent attributes to fulfill basic needs, so that the game can be made highly educational and stimulating.

5 Claims, 3 Drawing Figures

EDUCATIONAL BOARD GAME

BACKGROUND OF THE INVENTION

1. FIELD OF THE INVENTION

The present invention generally relates to games and more particularly to educational board games of skill and of chance.

2. PRIOR ART

The usual types of board games involve either skill or chance, but not a combination of both. Moreover, many such games offer no educational advantages for the players. In addition, when one or more pathways are provided on conventional game boards for progressive movement of player markers during the game, either the pathways are individual to the individual players or there is only one pathway which is for use by all players. While each marker can progress or regress along its pathway in response to chance as determined by dice, drawing, etc., there is no opportunity to cross over to other pathways and thus greatly complicate the game and make it more interesting.

Accordingly, there is a need for a simple, inexpensive board game that provides excitement for a number of players through the operation of chance, yet developes skill and requires reasoning for best results. Such game should be adaptable for play by a number of players of various ages, yet provide educational benefits for all.

SUMMARY OF THE INVENTION

The foregoing needs have been satisfied by the present invention which is substantially as set forth in the Abstract above. In this regard, a novel game is provided. In a preferred embodiment, it includes a game board, markers for the players, dice or other marker movement determining means (such as cards or a roulette wheel and ball), reward tokens, and tally figures, preferably three-dimensional representations of animals. The tokens preferably include components such as representations of feathers or fur of the animals attachable to the figures by token receiving means.

The game board is divided into a number of circuitous pathways, each representing a different need to be fulfilled for the figures.

Each pathway has a plurality of transfer stations bearing indicia, such as color coding, which makes them different from each other but identical to certain other transfer stations in the other pathways. Penalty and reward stations are interspersed with the transfer stations along each pathway. Preferably, each pathway intersects other pathways at a common point, with each traverse of a selected pathway bringing a reward and the opportunity to embark on another pathway.

Tally sheets may also be provided, listing attributes or aids which are collected as rewards until the needs of the figures are fulfilled. If desired, a conventional game board can be dispensed with and the novel game can be played on an open playing field with pathways, transfer points, etc., located thereon, and with use of human players to traverse each path. Other features of the invention are set forth in the following detailed description and accompanying drawings.

DRAWINGS

DETAILED DESCRIPTION

Figure 2:
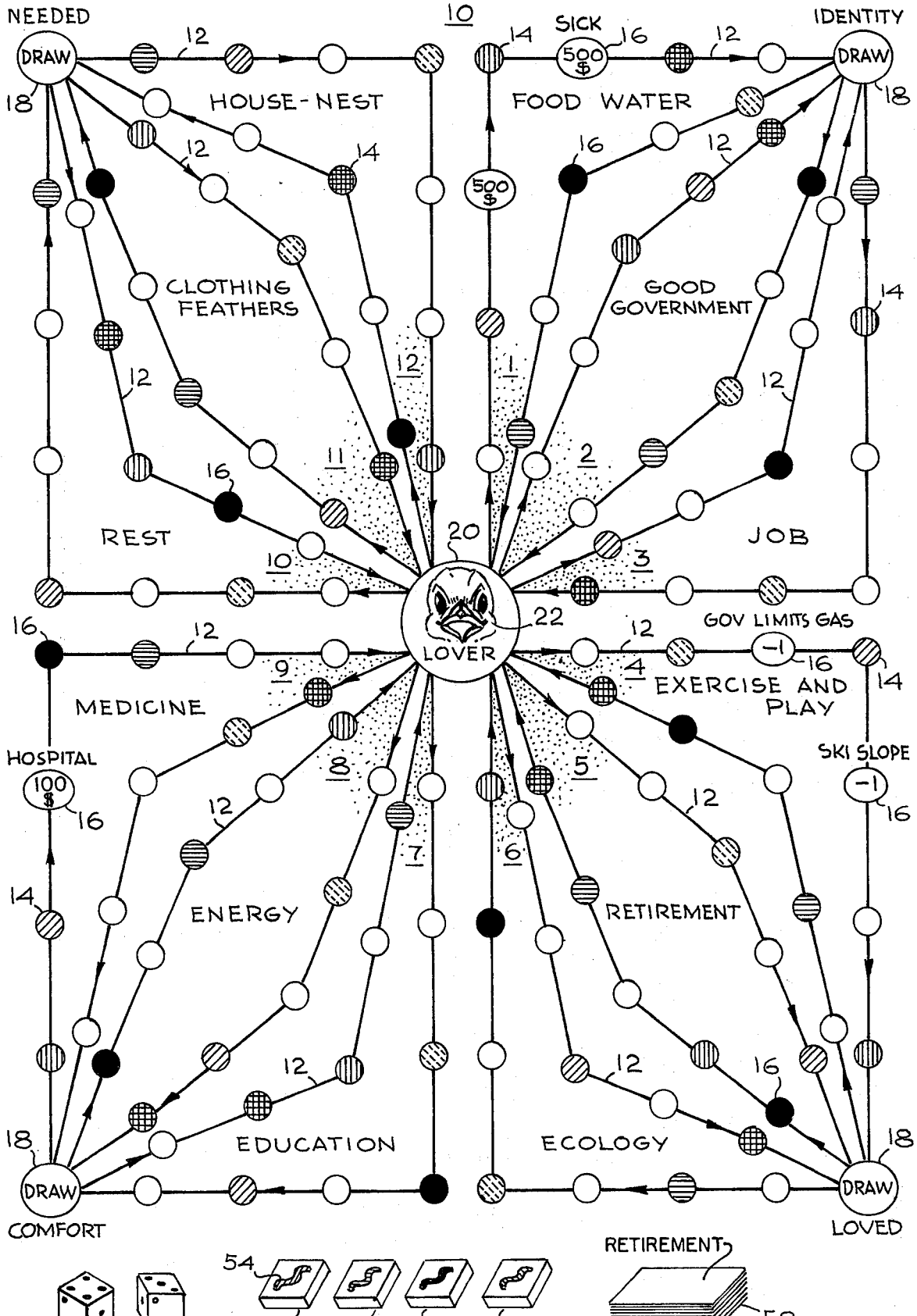
FIG. 2 is a schematic perspective view of a preferred embodiment of the game board, dice, markers and cards utilized in the board game of the present invention.

In FIG. 2 of the drawings, a preferred embodiment of the game board used in the board game of the invention is depicted. Thus, a board 10 is shown which bears a plurality of separate circuitous pathways 12. Each of the twelve pathways 12 shown in FIG. 2 has disposed along its length at spaced intervals a plurality of transfer stations 14. Interspersed with transfer stations 14 are penalty stations 16. Moreover, each pathway 12 is connected at its midway point with a reward station 18 marked "Draw" and at both of its ends with a central reward space 20 bearing the likeness of an animal 22. Space 20 is connected to both ends of all pathways 12.

Transfer stations 14 bear indicia, in this instance a solid coding color, with different colors for the various transfer stations 14 in any given pathway 12. However, there is at least one transfer station 14 of a given color in each of the twelve pathways 12.

The pathways 12 are marked with different identifying indicia, e.g., "House-Nest", "Job", "Food Water", "Exercise and Play", "Retirement", "Education", "Ecology", "Energy", "Medicine", "Rest", "Clothing feathers", and "Good Government", representing needs which, when attended to, lead to a completely fulfilled individual.

The penalty stations 16 represent pitfalls during life in striving towards personal fulfillment. Thus, for example, certain of stations 16 are designated with a dollar value which represents monetary loss as a result of the misfortune or calamity specified at the given station 16. Other stations can be designated with the calamity and the notation "−1". This means the loss of a previously obtained reward, as more particularly described hereinafter. Still others of the penalty stations 16 are black. Rules regarding penalties for landing therein are set forth in detail hereinafter.

Figure 1:
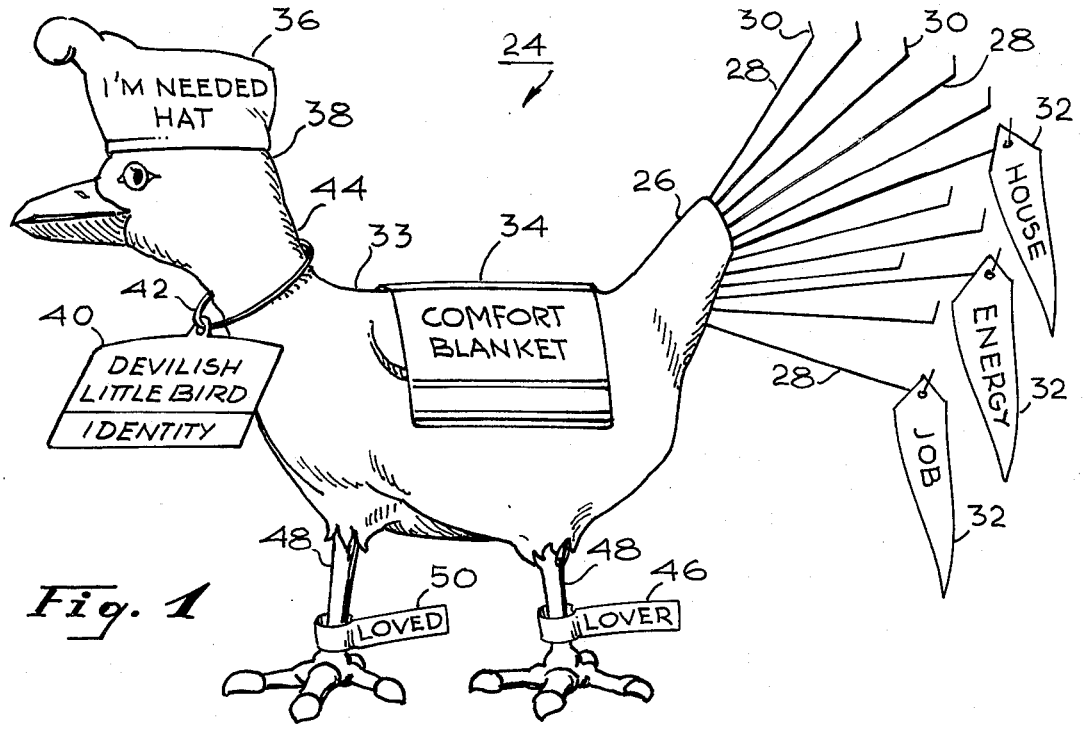
FIG. 1 is a schematic side elevation of a preferred embodiment of a three-dimensional board figure utilized in the board game of the present invention.

Referring more particularly to FIG. 1, a three-dimensional animal in the form of a bird 24 is depicted schematically. Bird 24 includes a tail portion 26 having a plurality (twelve) of elonggted rods 28 with upturned ends 30 upon which may be detachably secured feathers 32 bearing indicia correspondng to those of the twelve pathways 12. Bird 24 also bears on its back 33 a detachable comfort blanket 34, a detachable "I'm Needed" hat 36 on its head 38, an identity sign 40 on a detachable ring 42 around its neck 44 and a detachable band 46 marked "Lover" on one leg 48 and a like detachable band 50 marked "Loved" on the other leg 48 thereof.

Bird 24 or a similar animal is provided for each player of the present game and is used as a tally to check the progress of the game. The first player to outfit his bird 24 with all twelve feathers 32, the comfort blanket 34, "I'm Needed" hat 36 and "Lover" and "Loved" bands 46 and 50, as well as identity sign 40, wins the game provided he or she is not in debt over a specified limit (2,000.00).

A marker 52 bearing a worm symbol 54 or other indicia is provided for each player, as shown in FIG. 2. Marker movement determining means in the form of a pair of dice 56 or the like can also be provided (FIG.

2), as well as a plurality of xards 58, each marked with indicia listing an attribute or cards necessary in order to gain a given feather 32. Cards (not shown) and feathers 32 function as reward tokens in the game. A tally sheet 60 (FIG. 3) preferably also is provided for each player, upon which is listed the aids necessary in order to obtain each feather. Each aid relating to a given feather must be marked off before that feather is obtained. It will be noted from FIG. 3 that the feathers require differing numbers of attributes, with the House-Nest feather requiring only 6 attributes and the Good Government feather requiring 20 attributes. It will also be noted in FIG. 3 that the top 12 attributes apply to one or more of the feathers, while the lower 12 attributes apply only to the Good Government feather, which requires the greatest number of attributes. An attribute under a given feather is marked off each time a player traverses the pathway 12 of a given feather, in a manner more clearly hereinafter set forth. The attributes under any given feather are those attributes required to achieve the particular given feather.

A stack of identity cards is also provided, which number at least 8, with each of such cards having a distinguishing name thereon.

It will be understood that the game of the invention can be played in any suitable manner and that, for example, a two-dimensional tally figure or other three-dimensional figure can be used in addition to or in place of bird 24. As previously noted above, the playing area can be a park or the like instead of a game board. Tokens for attachment to such a figure can be, for example, stripes, in the case of a zebra figure. It will also be understood that the number and arrangement of pathways 12, transfer stations 14, penalty stations 16, and reward stations 18 can be changed, as desired. So also can the indicia for the pathways 12, markers 52, stations 14, 16 and 18 and cards 58. Likewise, the game board can have multiple intersecting pathways, or can be laid out in a sunburst fashion. Additionally, the game can be laid out on a three-dimensional basis rather than on the two dimensional basis outlined above. The board 10 and the other named components of the present game can be made of any suitable one or mixture of materials, for example, cardboard, metal or plastic for board 10, colored printing defining pathways 12, stations 14, 16 and 18 and space 20 on board 10, etc.

One preferred manner of playing the game of the present invention may be described as follows:

The game is played with two to four players and begins with each selecting a name for his bird 24 from among those eight names which are available in a pile of identity cards. When, during the course of the game, a player's marker lands on the "Identity" reward station 18, the player is allowed to draw from the identity pile of cards. If he selects the card which lists the same name as he has previously designated, he affixes identity sign 40 about his bird's (24) neck 44 via ring 42 and thus fulfills one of the requirements for winning the game.

The dice 56 are shaken and thrown in turn by each player. The player obtaining the highest number on the throw is first. Next is the player on his left and so on. The player who is first throws the dice again. The number thrown determines which numbered pathway 12 his marker 52 will follow from space 20 and back to space 20. He throws the dice again to determine the number of steps or stations he traverses along the pathway. In order to avoid a penalty station 16, he can color transfer from a transfer station 14 he encounters before the penalty station 16 to any transfer station 14 of a like color in another pathway 12. The act of transferring counts for one station (or step). In one form of the game, only one color transfer per turn by a player can be made.

Figure 3:
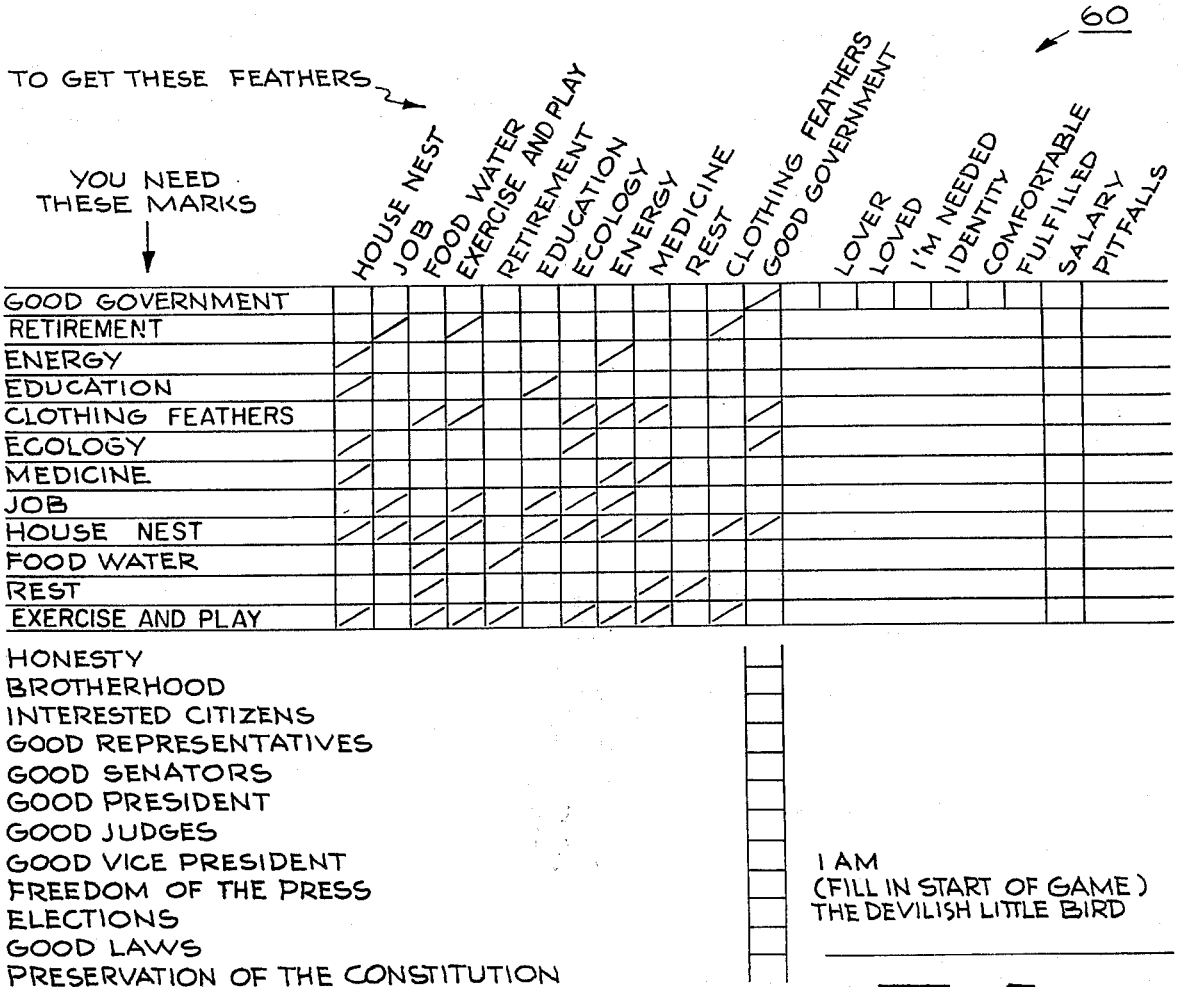
FIG. 3 is a schematic top plan view of a tally sheet used in the board game of the present invention.

In any event, when the number of stations corresponding to the number the player has thrown have been reached, and the resulting penalties and/or rewards, if any, have been applied, depending on at what station the maker 52 lands, the player's turn is over. The turn can also be terminated by an imposed reward limit. The next player (the one to his left) then repeats the described procedure. If a player's marker 52 lands on a penalty station 16 which, for example, calls for $100.00 penalty, this amount is listed by the player in the pitfalls column on his own tally sheet 60 (FIG. 3). A player cannot win the game if, for example, he owes over $2,000.00 in pitfalls, or if he has not encountered the prescribed number of pitfalls. He, however, can offset these with salary obtained by completing the navigation of the "Job" pathway, and obtaining $500.00 with no feathers already obtained, $1,000.00 if an education feather has already been obtained, $1,500.00 if education and energy feathers have already been obtained and $2,000.00 if, in addition, a good government feather has been obtained. Any such pitfall deficit may also be reduced by trading reward cards previously obtained. The specific dollar amounts employed would be determined by reference to the set of rules specified.

Stations 18 are located in the four corners of board 10 and are individually designated "Loved", "Comfort", "Needed" and "Identity". If a player's marker lands on the "Loved" station 18, the player draws a "Lover" card from each of the other players having one. When a player has six of these cards, his bird 24 is given a "Loved" band 50. When a player has given six such cards to others in the course of the game, his bird 24 receives a "Lover" band 46. If a player lands on the "comfort" station 18, he receives the comfort blanket 34 for his bird 24, and he receives the "I'm Needed" hat 36 when he has landed on the "Needed" station 18 a sufficient number of times to have drawn a complete set of "Needed" cards.

When a player's marker has progressed to space 20 (has completed a pathway 12) with steps left over, the player places a mark on his score sheet in the box of his choice next to the aid or attribute listed there under the name of the pathway just traversed and he also draws an attribute card 58 relating to the same pathway (except for Good Government, and Rest where there are no cards). He then throws the dice to determine which is his next numbered pathway, and then the dice are thrown to determine how many steps forward on that new pathway his marker moves. (The number of color transfers is determined in another version by a throw of the dice.) As can be seen from tally sheet 60 (FIG. 3), the various feathers corresponding to the various pathways have different labelled attribute boxes below them. Thus, for example, "House-Nest" has the boxes, attributes or aids of "Good Government", "Retirement", "Clothing Feathers" "Job", "Food Water" and "Rest", while the "Clothing Feathers" feather has all listed boxes "Retirement," "House-Nest," and "Exercise and Play" and the last 12 listed are for the "Good Government" feather.

If the player's marker arrives at space 20 in exactly the required number of steps, the same rewards are obtained as described above; also a "Lover" card is given, and the player is then allowed to trade cards with any other willing player under specified rules. Feathers are obtained when all open attribute boxes on a player's sheet 60 for a given pathway have been marked off. The same unmarked boxes for all other pathways are then marked off. This speeds up the game. It will be noted that for a "Good Government" feather, it is necessary to have 20 boxes marked or checked off while the other feathers require many less checked boxes.

When a player's marker lands on a black station 16, then the player to his left draws one of the unlucky player's cards that go with the pathway he is on at the time the black station 16 is encountered. The cards that go with each particular pathway can be set forth in the basic rules of the game. However, if the black station 16 is on a pathway 12 which has no cards or if the unlucky player has no cards for the pathway, the player to his left throws the dice, transferring the unlucky player's marker to the black station of the numbered pathway corresponding to the dice thrown and then drawing a card from the unlucky player for that new pathway. If there is no such card, then the dice throwing, transferring and drawing are repeated once more. If there still is no card to be drawn, the penalty ends at that point.

Accordingly, the described game provides both rewards and penalties and means for avoiding the latter to obtain the former. It will be noted that the indicia for the feathers and marks, pathways and stations are such as to communicate a considerable knowledge and insight regarding human nature, its needs and fulfillments and the elements which go toward satisfying those needs. Accordingly, while the present game is essentially simple to play, much of a recreational and educational nature can be obtained by playing it. The game's equipment is simple and easy to manipulate, yet the game has both variety and uniqueness. Moreover, it requires skill and insight for maximum results.

Accordingly, it is believed to be a substantial improvement over the art and combines a number of desired characteristics. Other advantages are as set forth in the foregoing.

Various modifications, changes, alterations and additions can be made in the present game, its components and in the manner of playing the game. All such modifications, changes, alterations and additions as are within the scope of the appended claims form part of the present invention.

What is claimed is:

1. A novel educational game, said game comprising, in combination:

a. A game playing area bearing a plurality of separate circuitous pathways, each said pathway bearing a plurality of separate transfer stations spaced therealong, each said transfer station bearing distinctive individual indicia, various indicia being utilized among said transfer stations, each said pathway also including penalty stations and reward stations interspersed with said transfer stations;

b. A plurality of individual player markers for progressive movement from station to station along said pathways, each said marker being transferable from any of said pathways at any of said transfer stations to a like transfer station on another of said pathways;

c. marker movement determining means;

d. A plurality of individualized reward tokens bearing indicia corresponding to indicia at said reward stations; and, e. A plurality of individual tally figures, each bearing a plurality of reward token-receiving means, whereby during operation of said game each tally figure can receive at least certain of said reward tokens to reflect progress towards a successful game conclusion.

2. The game of claim 1 wherein each said pathway commences and ends at a common central reward space.

3. The game of claim 2 wherein said figures each comprise a three-dimensional representation of an object, and said reward tokens include representations of components of said objects, for installation thereon through said token-receiving means.

4. An educational game for educating one in attaining desirable social achievements in society and understanding the ingredients necessary to obtain such values, including as understanding of the interrelationships of such ingredients, said game including, a tally sheet listing a plurality of achievements, and associated therewith a listing of the ingredients necessary to attain each achievement, a game playing area having thereon a plurality of paths with indicia thereon serving to represent said ingredients, said paths having a plurality of stations associated therewith, game means including markers to enable progress along said stations, transfer means to enable transfer between said paths and therefore enable the complete traverse of remaining stations in the path transferred to, to thereby complete such path, whereby a given achievement is attained only when a predetermined number of paths are completed by moving a marker from the last station on each path, to thereby signify the obtaining of a predetermined corresponding number of ingredients listed on the tally sheet as being needed to effect a particular achievement.

5. The educational game set forth in claim 4, and further including reward means for rewarding a player, and penalty means for penalizing a player.

* * * * *